United States Patent [19]

Jacobsson

[11] Patent Number: 4,607,506

[45] Date of Patent: Aug. 26, 1986

[54] YARN FEEDING DEVICE

[75] Inventor: Kurt A. G. Jacobsson, Ulricehamn, Sweden

[73] Assignee: Aktiebolaget IRO, Ulricehamn, Sweden

[21] Appl. No.: 655,203

[22] Filed: Sep. 26, 1984

[30] Foreign Application Priority Data

Sep. 27, 1983 [SE] Sweden ..... 8305194
Jun. 13, 1984 [DE] Fed. Rep. of Germany ..... 3421941

[51] Int. Cl.[4] ..... D04B 15/48

[52] U.S. Cl. ..... 66/125 R; 66/163; 242/47.01

[58] Field of Search ..... 66/125 R, 132 R, 132 T, 66/163; 242/47.01

[56] References Cited

U.S. PATENT DOCUMENTS 3,820,731 6/1974 Rosen ..... 242/47.01 X
3,928,987 12/1975 Jacobsson ..... 66/132 R
4,067,508 1/1978 Jacobsson ..... 242/47.01
4,114,823 9/1978 Fecker et al. ..... 242/47.01
4,271,687 6/1981 Memminger et al. ..... 66/132 T X

FOREIGN PATENT DOCUMENTS 2926814 1/1981 Fed. Rep. of Germany .... 66/125 R

*Primary Examiner*—Wm. Carter Reynolds
*Attorney, Agent, or Firm*—Flynn, Thiel, Boutell & Tanis

[57] ABSTRACT

A device for the positive feeding of a yarn, particularly for knitting machines, having a rotatable storage drum adapted to have a yarn supply wound thereonto and withdrawn therefrom over a rim thereof, a stationary yarn guide element located below the rim and outwards of the periphery of the rim in a center plane extending through the axis of rotation of the storage drum, a yarn guiding element located in the yarn path between the rim and the yarn guide element and formed with a yarn guiding edge, and a stoppage sensing element having a portion extending parallel to a tangent of the rim transversely of the yarn path between the yarn guiding edge and the yarn guide element, and being mounted for pivotal movement under the action of a biasing force. The yarn guiding edge extends substantially rectilinear and parallel to the portion of the stoppage sensing element, and its end extends beyond the center plane and is adjoined by a yarn support edge which is located beyond the center plane and gradually recedes in a direction parallel to the plane of the rim or extends obliquely away therefrom.

8 Claims, 2 Drawing Figures

YARN FEEDING DEVICE

DESCRIPTION

1. Field of the Invention

The present invention relates to a yarn feeding device for a knitting machine.

2. Background of the Invention

Known from U.S. Pat. No. 3,928,987 (DE-OS No. 23 41 498) is a yarn feeding device with axial yarn withdrawal, wherein the yarn guiding edge is formed by the mouth of a hook opening in the direction of rotation of the storage drum. In the case of a yarn oversupply, the decreasing yarn tension results in the formation of a loop, causing the stoppage sensing element to pivot outwards so as to stop the feeding device. The storage drum idles on for a certain period and thereby releases the yarn from the mouth of the hook. After the cause of the oversupply has been eliminated, and prior to restarting the yarn feed operation, the yarn has to be returned to the mouth of the hook, and the stoppage sensing element has to be reset to its original position. The resetting of the stoppage sensing element requires the presence of a certain resistance on the yarn arriving from the periphery of the drum. In the case of this known yarn feeding device this resistance is produced by a yarn braking ring seated on the peripheral surface of the drum.

In a yarn feeding device of the type known from U.S. Pat. No. 4,114,823 (DE-OS No. 26 42 183), the yarn braking ring may be eliminated, because the yarn guiding element itself is capable of producing the tension in the yarn running off the periphery of the drum as required for resetting the stoppage sensing element. To this purpose the yarn guiding element is formed with a narrow slot adjacent the yarn guiding edge, said slot being located in the center plane and extending to a point beyond the axis of rotation of the storage drum. The width of the slot is determined in accordance with the thickness of the respective yarn. This construction suffers from the disadvantage that the yarn guiding element is of rather complicated construction and thus relatively expensive, and can only be suitably employed for yarns the thickness of which varies within a narrow range. Yarns having a greater or lesser thickness require the use of a yarn guiding element having a wider or narrower slot, respectively. In the case of a yarn oversupply, when the stoppage sensing element is pivoted to a position for stopping the device, the idling storage drum continues to feed a certain length of yarn sufficient for the yarn to be displaced from its correct positive yarn feeding path over the guiding edge and introduced into the slot to extend therein in the direction towards the axis of rotation of the storage drum and to thereby follow the movement of the stoppage sensing element. During this movement the yarn is guided along both edges of the slot. This construction of the yarn guiding element leads to the danger that after the device has been stopped, the yarn loop depending from the periphery of the storage drum hangs down laterally over the outer edge of the guiding element, so that the yarn length extending towards the leg of the stoppage sensing element is deflected by an angle of about 180°. After the obstruction has been cleared, renewed traction on the yarn results in the occurrence of a momentous increased resistance against the supply of the yarn, which may even lead to yarn breakage, and whereby the stoppage sensing element is abruptly entrained towards the stationary yarn element. Subsequently when the laterally depending yarn loop is gradually taken up, the resistance against the withdrawal of the yarn sharply decreases, so that the stoppage sensing element may again pivot to its stopping position so as to restop the device, or may be induced to perform strong pendulum movements. In addition, the slot results in the disadvantage that it may give rise to the accumulation of dust, e.g. of fibres of the yarn passing therethrough.

It is an object of the present invention to provide a yarn feeding device of the type defined in the introduction, wherein the yarn guiding element is of simplified construction and thus less expensive than the prior art yarn guiding element, and wherein the yarn guiding element exerts a reduced load on the yarn on resumption of the positive yarn feed after the occurrence of an oversupply, while nevertheless ensuring that on resumption of the yarn feeding operation the stoppage sensing element is swiftly returned to its position for the correct positive yarn feeding operation.

This object is attained according to the invention by a yarn feeding device, particularly for the positive feeding of a yarn to a knitting machine, comprising a rotatably drivable storage drum adapted to have a yarn supply wound onto its periphery and to have the yarn withdrawn therefrom over a rim of the storage drum at a withdrawal speed corresponding to the winding speed, a stationary yarn guide element located below the plane of the rim and outwards of the periphery of the rim in a center plane extending substantially through the axis of rotation of the storage drum, a yarn guiding element having a yarn guiding edge located in the path followed by the yarn during a correct positive yarn feeding operation between the rim and the yarn guide element, and a stoppage sensing element having a transverse portion supported on the yarn and extending across the yarn's path substantially parallel to a tangent of the rim between the yarn guiding edge and the yarn guide element, the stoppage sensing element being pivotally mounted and biased by a biasing force in a direction biasing the yarn into engagement with the yarn guiding edge, the yarn guiding edge extending substantially rectilinear and parallel to the transverse portion, the yarn passing over the guiding edge and under the transverse portion so that the biasing force acting on the stoppage sensing element holds the yarn in engagement with the guiding edge, one end of the yarn guding edge extending beyond the center plane and being adjoined to a yarn support edge which is located rearwards of the center plane as seen in the direction of rotation of the storage drum and which gradually recedes—as seen from said yarn guide element—so as to extend in a direction away from the transverse portion.

In the case of only a slight oversupply, the transverse portion directs the yarn over the yarn guiding edge without the latter being prevented from shifting laterally, whereby the slight oversupply is compensated. If the oversupply is increased, the stoppage sensing element moves to its stop position so as to stop the yarn feeding device. The idling storage drum still feeds a length of yarn, so that a loop is formed extending around the yarn guiding edge laterally outwards of the center plane. The yarn is capable of moving along the rectilinear yarn guiding edge and towards the yarn supporting edge with a negligible resistance. If the loop is of such a size that it no longer engages the yarn support edge, it depends laterally adjacent the yarn support edge down to the transverse portion of the stoppage sensing element. After the cause of the oversupply has been eliminated, the yarn is again taken up so as to increasingly engage the yarn support edge, whereby the stoppage sensing element is continuously and steadily moved towards its position for the correct positive yarn feeding operation. Thanks to its engagement with the yarn support edge, the yarn is subjected to a braking action, resulting in a particularly effective although gentle generation of the resistance required for ensuring that the loop is taken up and the stoppage sensing element is returned to its above mentioned position, while no further yarn windings are withdrawn at first from the yarn supply carried on the storage drum. Thanks to the shape of the yarn support edge, the continued return movement of the stoppage sensing element results in the yarn being gradually guided onto the yarn guiding edge to extend thereover as soon as the regular positive yarn feeding operation is taken up again.

An advantageous embodiment of the invention is characterized by the yarn support edge having a first section formed by an obtuse angle with the yarn guiding edge, and a second section which is effectively open-ended and forms a further obtuse angle with the first section. After the device has been stopped and as the storage drum idles out, the deflected yarn may readily pass the obtuse angle between the yarn guiding edge and the first section of the yarn support edge, whereupon it forms a laterally oriented loop, or is caused, respectively, by the first section to form the laterally oriented loop. The obtuse angle between the two sections of the yarn support edge constitutes a slight obstacle for the yarn, so that the latter still remains in the range of the first section with the storage drum stationary. On resumption of the positive yarn feeding operation, when the outgoing yarn is put under tension, the yarn support edge, or rather the first section thereof, is effective to gently create a retaining force in the yarn sufficient to ensure the steady return of the stoppage sensing element towards its position for the correct positive yarn feeding operation, without any further yarn windings being withdrawn from the storage drum before the loop previously formed by the idling rotation of the storage drum has been completely taken up.

In practical use an embodiment wherein each of the obtuse angles are about 135° has been found particularly effective. With the angular relationships defined in this claim, the second section of the yarn support edge extends at an angle of 90° with respect to the yarn guiding edge, while the first section forms an angle of 45° with the direction of the outgoing yarn. This inclination of the first section is effective to promote the return of the yarn towards the yarn guiding edge on resumption of the positive yarn feeding operation.

A further advantageous embodiment is characterized by the yarn guiding element comprising a metal or plastic platelike member formed with a laterally-opening recess which is at least partially defined by the yarn guiding edge and the yarn support edge. This enables the yarn guiding element to be manufactured to accurate dimensions in a simple and inexpensive manner, and to be mounted without difficulty. The laterally open recess offers the advantage that on threading of the yarn prior to initiating operation of the yarn feeding device, the yarn has merely to be introduced into the laterally open recess so as to immediately assume its correct position therein. The need of the end of the yarn having to be threaded through any openings or of the provision of a threading slot in the yarn guiding element are thus eliminated.

A further important provision is characterized by the yarn guiding edge and yarn support edge each being formed with a guide surface extending substantially parallel to the yarn as the latter extends from the drum to the transverse portion of the stoppage sensing element during correct positive yarn feeding. This guiding surface may be engaged by the yarn during the correct positive yarn feeding operation and even in the case of initial oversupply and gradually pivoting stoppage sensing element. Along the guiding surface and over the edges of the yarn guiding element defining the guiding surface there occur desirable frictional forces acting on the yarn. These frictional forces are also of importance at the location of the yarn support edge for retention of the yarn during the return movement of the stoppage sensing element.

A further suitable embodiment, in which the yarn guiding element is secured to a stationary support of the yarn directing element, provides an arcuate rear edge between the support and the yarn supporting edge for preventing the yarn from becoming fouled in the case of an excessively great depending loop. The spatulate surface of the yarn guiding element is effective to intercept a loop as it falls down, so as to prevent such loops from becoming entangled with the stoppage sensing element or with the yarn section extending towards this element. In relation to the center plane of the yarn feeding device, the spatulate surface has a considerable lateral extent in the direction in which a further yarn winding might drop off the storage drum as the latter idles out.

Finally the arrangement of the stoppage sensing element in the stop position results in the yarn still remaining in the range of the first section of the yarn support edge as the storage drum idles out, so that, after the cause of the oversupply has been eliminated, the resumed pull on the yarn causes the latter to readily slide back onto the guiding edge while exerting the required resistance for the stoppage sensing element to be returned to its operating position.

BRIEF DESCRIPTION OF THE DRAWINGS

An embodiment of the invention shall now be described by way of example with reference to the accompanying drawings, wherein.

DETAILED DESCRIPTION

Figure 1:
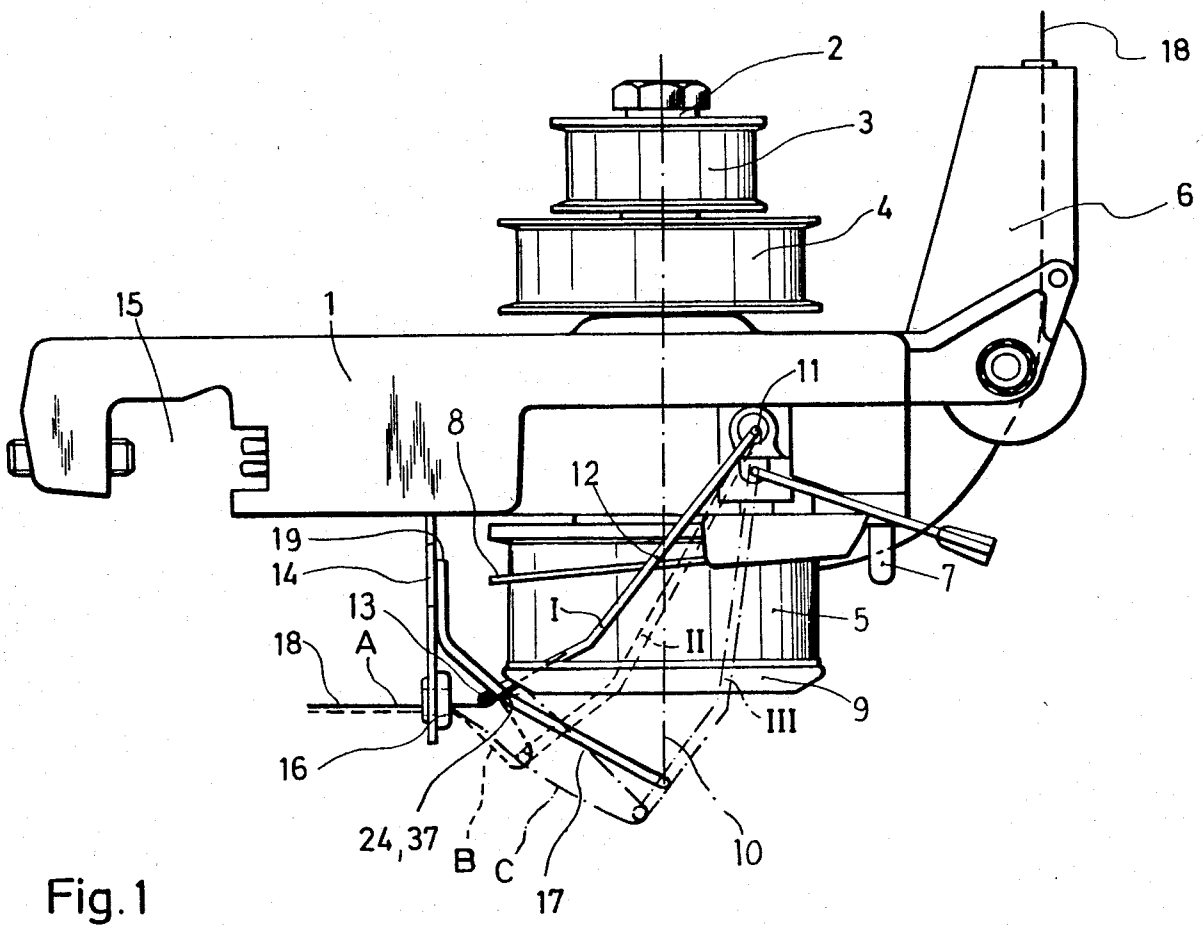
FIG. 1 shows a diagrammatical side view of a yarn feeding device.
Figure 2:
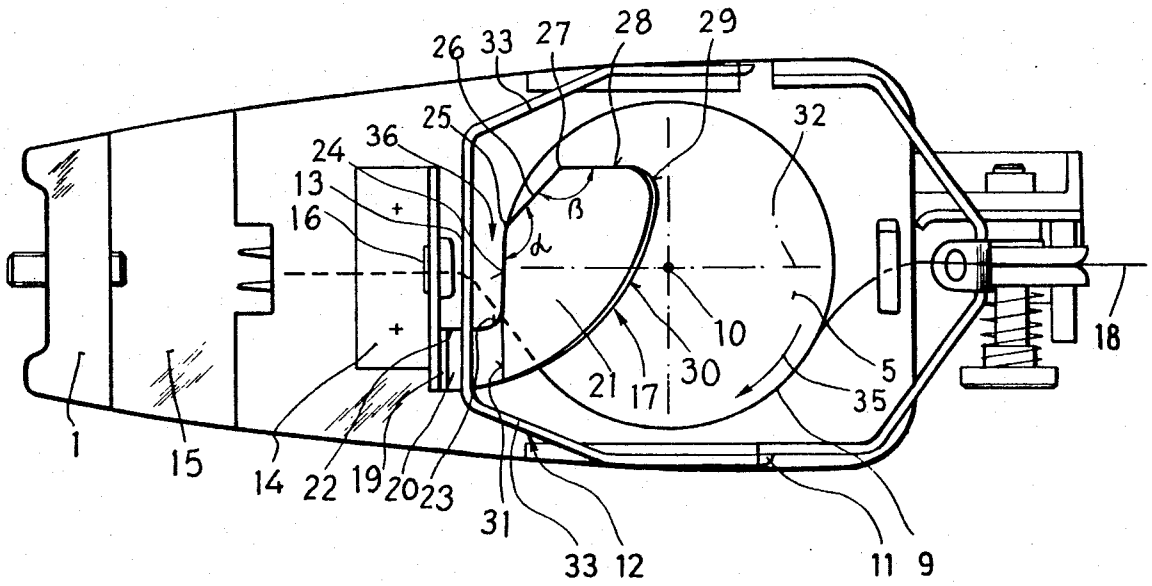
FIG. 2 shows a diagrammatical bottom plan view of the yarn feeding device of FIG. 1.

A yarn feeding device designed particularly for positive yarn feeding operation in a knitting machine has a frame 1 for rotatably supporting in a not shown manner a drive shaft 2 carrying a pair of pulleys 3, 4 secured thereto on one side of frame 1. On the other side of frame 1 a storage drum 5 of conventional type is secured to shaft 2. Secured to one end of frame 1 is a yarn guide 6 and a yarn guide eyelet 7 preferably of hook-shaped configuration. Associated with the periphery of storage drum 5 is an element 8. At its end facing away from frame 1 storage drum 5 is formed with a projecing peripheral rim 9. The axis of rotation of drum 5 is indicated at 10. Pivotally mounted in a bearing 11 associated with frame 1 is a loop-shaped stoppage sensing element 12 biased in the counterclockwise direction in FIG. 1 by a small biasing force, e.g. by means of a spring or a counterweight. Sensing element 12 has a rectilinear portion 13 extending parallel to a tangent contacting rim 9 of storage drum 5 and having a length substantially corresponding to the diameter of rim 9 (FIG. 2). Stoppage sensing element 12 is shown in solid lines in a first position I for positive yarn feeding operation. Element 12 is further shown in dotted lines in an intermediate position II assumed in the case of yarn oversupply. Element 12 is finally shown in dash-dotted lines in a third position III in which it may be locked for substantially axial yarn withdrawal. Stoppage sensing element 12 is operatively connected in a not shown manner to a stop switch so as to actuate it between positions II and III for stopping the rotary drive of storage drum 5. In position III, stoppage sensing element 12 is passive with respect to the stop switch.

Frame 1 is further provided with a support 14 for a stationary yarn guide element 16 in the form for instance of a laterally slotted eyelet. Guide element 16 is disposed at a slightly lower level than rim 9 in the center plane of the yarn feeding device indicated at 32 in FIG. 2 and extending through rotary axis 10 of storage drum 5. The rectilinear portion 13 of stoppage sensing element 12 is located between rim 9 and guide element 16 (in position I) and intersects center plane 32 at right angles.

Frame 1 is further formed with a recess 15 for securing the yarn feeding devide to a carrier ring (not shown).

Secured to support 14 is one end portion 19 of a yarn guiding element 17 formed of a metal or plastics plate member. Extending obliquely downwards from end portion 19 is a narrow leg portion 20 ending in a widened spatulate surface portion 21. Surface portion 21 is bent with respect to leg portion 20 along a bent edge 31 so as to extend obliquely below storage drum 5 to a point adjacent axis of rotation 10. Yarn guiding element 17 is formed with a laterally open recess 36 defined by end portion 19, an inner edge 22 of leg portion 20, a rounded edge 23 between leg portion 20 and spatulate surface portion 21, a rectilinear yarn guiding edge 24 extending parallel to end portion 19 or rectilinear portion 13, respectively, and a yarn support edge comprising a first section 26 and a second section 28. First section 26 forms an obtuse angle $\alpha$ of about 135° with yarn guiding edge 24. The two sections 26 and 28 include an obtuse angle $\beta$ likewise of about 135°. The yarn guiding edge 24 extends beyond the center plane 32 and is adjoined to the aforementioned yarn support edge defined by sections 26 and 28, the latter being located rearward of the center plane 32 as seen in the direction of rotation of the storage drum, and this yarn support edge as defined by sections 26 and 28 gradually recedes, as seen from the yarn guide element 16, so as to extend in a direction away from the transverse portion 13 of the sensing element 12. The yarn support edge defined by sections 26 and 28, as it projects away from the yarn guiding edge 24, intersects an imaginary downward extension of the outer periphery of the storage drum rim 9. The intersections 25 and 27 between the described edges are suitably rounded. Second section 28 of the yarn support edge runs out in a rounded edge 29, from which a convexly arcuate rear edge 30 leads back to leg portion 20.

From FIG. 2 it is evident that stoppage sensing element 12 has a pair of converging legs 33 extending to opposite ends of rectilinear portion 13.

In the embodiment shown, storage drum 5 is adapted to be rotated in the direction of an arrow 35 in FIG. 2. Yarn guiding edge 24 and the two sections 26 and 28 of the yarn support edge are formed with chamfered guide surfaces 37 (FIG. 1) for a yarn 18 supplied via yarn guide 6 and yarn guide eyelet 7 for being tangentially wound onto the periphery of storage drum 5. On drum 5 yarn 18 forms a supply consisting of several windings, from which the yarn is withdrawn obliquely downwards over rim 9 and yarn guiding edge 24, and underneath rectilinear portion 13 of stoppage sensing element 12 towards yarn guide element 16, as shown in solid lines and indicated at A in FIG. 1. This state corresponds to the position for positive yarn feeding operation, in which yarn 18 is withdrawn from drum 5 at the same speed at which it is wound onto the storage drum 5. As the yarn is being withdrawn under these conditions, it is kept under sufficient tension for resisting the downwards directed force of stoppage sensing element 12, so that the latter remains at its first position I. In this state, the portion 13 of the sensing element 12 is disposed substantially directly below the recess 36.

In the case of the occurrence of oversupply, in which case yarn 18 is withdrawn from drum 5 with a lower speed than the speed at which it is wound thereonto, the tension of yarn 18 decreases, permitting stoppage sensing element 12 to drop to its intermediate position II. This results in yarn 18 being pulled sharply around yarn guiding edge 24 to the position indicated at B in FIG. 1. Slightly beyond its intermediate position II, stoppage sensing element 12 actuates a switch for stopping the rotary drive of storage drum 5, as the sensed oversupply is of a magnitude indicating the occurrence of a malfunction. Storage drum 5 does not immediately stop, however, but idles out for a short period of time, whereby the outgoing yarn becomes practically slack and is carried in the direction of rotation 35 along guiding edge 24 and onto first section 26 of the yarn support edge by the continued rotation of drum 5. This results in the formation of a laterally oriented loop extending from rim 9 of storage drum 5 over first section 26 of the yarn support edge and then obliquely downwards to rectilinear portion 13 of stoppage sensing element 12. From there yarn 18 extends again upwards and through yarn guide element 16. When the stoppage sensing element 12 is in its stop position, the yarn 18 normally extends closely adjacent the junction 27 between the sections 26 and 28 of the yarn support edge.

As soon as the malfunction causing the oversupply to occur has been eliminated, yarn 18 is again withdrawn. During the initial phase, yarn 18 is supported on first section 26 of the yarn support edge, until the previously formed loop has been taken up and stoppage sensing element 12 returns to its first position I before the withdrawal of the yarn from the storage drum is resumed. At the same time, yarn 18 moves off yarn support edge 26, 28 and onto yarn guiding edge 24. Also shown in FIG. 1 is the third position III of stoppage sensing element 12 with the resultant sharp deflection of the yarn loop C below and around the yarn guiding element.

Yarn guiding element 17 might also be secured to another portion of the yarn feeding device so as to project towards yarn guide element 16 from the opposite side. Element 17 might also be formed as a suitably bent wire loop. If storage drum 5 were to be rotated in the opposite direction, yarn guiding element 17 would have to be replaced by a mirror-symmetrical element of substantially similar configuration. From FIG. 2 it is also evident that yarn guiding edge 24 extends substantially tangential with repect to rim 9 of storage drum 5, while sections 26 and 28 of the yarn supporting edge extend inside an imaginary extension of the outer periphery of the storage drum rim 9.

I claim:

1. A yarn feeding device, particularly for the positive feeding of a yarn to a knitting machine, comprising a rotatably drivable storage drum adapted to have a yarn supply wound onto its periphery and to have the yarn withdrawn therefrom over a rim of said storage drum at a withdrawal speed corresponding to the winding speed, a stationary yarn guide element located below the plane of said rim and outwards of the periphery of said rim in a center plane extending substantially through the axis of rotation of said storage drum, a yarn guiding element having a yarn guiding edge located in the path followed by the yarn during a correct positive yarn feeding operation between said rim and said yarn guide element, and a stoppage sensing element having a transverse portion supported on said yarn and extending across the yarn's path substantially parallel to a tangent of said rim between said yarn guiding edge and said yarn guide element, said stoppage sensing element being pivotally mounted and biased by a biasing force in a direction biasing said yarn into engagement with said yarn guiding edge, the improvement wherein said yarn guiding edge extends substantially rectilinear and parallel to said transverse portion, said yarn passing above said yarn guiding edge and under said transverse portion so that the biasing force acting on said stoppage sensing element holds the yarn in engagement with the yarn guiding edge, one end of said yarn guiding edge extending beyond said center plane and being adjoined to a yarn support edge which is located rearwards of said center plane as seen in the direction of rotation of said storage drum and which gradually recedes—as seen from said yarn guide element—so as to extend in a direction away from said transverse portion.

2. A yarn feeding device according to claim 1, wherein the yarn support edge, as it projects away from the yarn guiding edge, intersects an imaginary downward extension of the outer periphery of the storage drum rim.

3. A yarn feeding device according to claim 2, wherein the yarn support edge has a first edge section which extends at an angle relative to the yarn guiding edge and is directed generally inwardly toward the drum so that the first section forms an obtuse angle with the yarn guiding edge, the yarn support edge having a second edge section which joins to and projects inwardly toward the drum from the first edge section so as to form a further obtuse angle therebetween.

4. A yarn feeding device according to claim 3, wherein said obtuse angles are each about 135°.

5. A yarn feeding device according to claim 3, wherein the yarn extends closely adjacent the junction between the first and second edge sections of the yarn support edge when the stoppage sensing device is in its stop position.

6. A yarn feeding device according to claim 1, wherein said yarn guiding element comprises a thin platelike member formed with a laterally-opening recess disposed adjacent one side of said drum, said recess being at least partially defined along one side thereof by said yarn guiding edge and said yarn support edge, and the transverse portion of the stoppage sensing element being disposed substantially directly below said recess during a correct positive yarn feeding operation.

7. A yarn feeding device according to claim 6, wherein the yarn guiding element is secured to a stationary support which also supports said yarn guide element, said yarn guiding element having an enlarged platelike part which is positioned substantially below said drum and defines said yarn guiding edge and said yarn support edge thereon, said yarn guiding element having a mounting part which is fixedly secured to said stationary support, said yarn guiding element including a bridging part which extends between said mounting part and said platelike part and closes off one end of said laterally-opening recess, said platelike part having a convexly-curved arcuate rear edge extending from the outer end of said yarn support edge back to an outer edge of said bridging part.

8. A yarn feeding device according to claim 1, wherein said yarn guiding edge is positioned adjacent the periphery of the rim as viewed from above and is positioned inwardly of said stationary yarn guide element and separated therefrom by an intermediate slotlike space which is elongated parallel to said yarn guiding edge, means associated with one end of said yarn guiding edge as located forwardly of said center plane as seen in the direction of rotation of the storage drum for closing off said slotlike space, and said yarn support edge as joined to said yarn guiding edge adjacent the other end thereof being deflected inwardly relative to the direction of the yarn guiding edge so as to project under the drum and intersect an imaginary extension of the periphery of the storage drum rim as viewed from above.

* * * * *